US005449161A

United States Patent [19]

Gysling

[11] Patent Number: 5,449,161

[45] Date of Patent: Sep. 12, 1995

[54] HARD COPY SHEET MEDIA PICK MECHANISM

[75] Inventor: Peter Gysling, Boise, Id.

[73] Assignee: Hewlett-Packard Company, Palo Alto, Calif.

[21] Appl. No.: 210,516

[22] Filed: May 11, 1994

[51] Int. Cl.[6] ..... A65H 3/06

[52] U.S. Cl. ..... 271/119; 271/117; 271/120

[58] Field of Search ..... 271/37, 38, 117-120

[56] References Cited

U.S. PATENT DOCUMENTS

| | | | |
|---|---|---|---|
| 1,461,358 | 7/1923 | Kloman | 271/37 |
| 1,986,558 | 1/1935 | Cross | 271/38 |
| 3,572,691 | 3/1971 | Heinricy | 271/120 X |
| 4,089,516 | 5/1978 | Colglazier et al. | 271/37 X |
| 4,223,884 | 9/1980 | Burnham et al. | 271/120 X |
| 5,188,350 | 2/1993 | Hayashi | 271/119 X |

FOREIGN PATENT DOCUMENTS

| | | | |
|---|---|---|---|
| 281653 | 5/1913 | Germany | 271/38 |
| 81330 | 4/1986 | Japan | 271/117 |
| 37044 | 2/1988 | Japan | 271/119 |
| 22743 | 1/1989 | Japan | 271/117 |
| 203128 | 8/1989 | Japan | 271/119 |
| 294133 | 11/1989 | Japan | 271/119 |
| 178124 | 7/1990 | Japan | 271/119 |
| 9006 | 4/1900 | Norway | 271/38 |

*Primary Examiner*—William E. Terrell
*Assistant Examiner*—Carol L. Druzbick

[57] ABSTRACT

A device for pre-picking a top sheet of media from a stack is disclosed. A biased friction pad is mounted on a D-shaped pick roller mechanism to engage the top sheet with a lighter force than that which follows when a similar friction pad on the D-shaped pick roller mechanism engages the sheet. Multiple sheet pick problems inherent with use of only a D-shaped pick roller mechanism are alleviated.

5 Claims, 2 Drawing Sheets

HARD COPY SHEET MEDIA PICK MECHANISM

BACKGROUND OF THE INVENTION

1. Field of the Invention

The present invention relates generally to media sheet feeders for hard copy machines, such as printing and plotting devices, more particularly to cut-sheet picking mechanisms for media sheet feeders and more specifically to a pre-pick device.

2. Description of the Related Art

Many office products such as computer printers and plotters, plain paper facsimile machines, and photocopiers use mechanisms that feed a single sheet of pre-cut printing medium (for example, a sheet of paper of a particular size such as standard letter size, legal size, or A-4 (metric), or transparencies, or envelopes) into the hard copy producing apparatus. These mechanisms are commonly referred to as "sheet feeders."

Sheet feeders usually are provided with an adjustable or replaceable media cartridge, tray, or other type of stacker in which a user can stack multiple cut sheets of the media. The use of cartridges adapted to the various styles of media provide a mechanism for quick changes between any particular printing medium by the user.

Sheet feeders generally provide a corner separation mechanism which holds down the lead corners of the stack of media which is biased, such as by spring loading, in the opposing direction. Upon receiving a FEED command from the hard copy machine controller electronics, a sheet picking device is actuated to deliver the top sheet from the stack over the resistance of the corner separation mechanism. As shown in FIG. 1, one popular mechanism for feeding the top sheet from the stack is a D-shaped roller 2 with a D-rim mounted friction member 10. This device is commonly referred to in the art as a "pick roller."

A pick roller 2 generally includes relatively flat, side plates 6, 8 and a radial, friction member 10 mounted (or integrally fabricated) on the D-rim shaped portion of the pick roller 2 between the side plates 6, 8. The pick roller 2 is mounted on a drive shaft 3 through a mounting aperture 4 connected to a drive motor 5. Upon a FEED command, the pick roller 2 rotates around its drive shaft 3 and the friction member 10 (such as a rubber pad (or "tire" section), cork, grit wheel, or other friction providing material) comes into contact with the surface of the top sheet of the counter-biased stack of media. The pick roller 2 is designed to generate enough downward force against the stack so that the force between the friction member 10 and the stack bias drives at least a top sheet of the stack forward. As the sheet moves forward, it must overcome the corner separator. Once the friction is sufficient to overcome the corner separator, the corner of the sheet snaps over the separator and the pick roller 2 moves the sheet into the hard copy machine where other transport mechanisms can take over.

One problem with the prior art is that pick rollers have a narrow range of media weight and type that will feed reliably. For example, with very light weight paper, the force of the pick roller against the biased media stack is transmitted to sheets of paper below the top sheet, causing more than one sheet of paper to snap over the corner separator. Picking multiple sheets is a common failure and usually requires the operator to halt operations to remove the extra sheets and to clear a resultant paper misfeed, or paper jam, error message from the machine.

Therefore, there is a need to expand the range of accurate, single sheet medium feed capability for hard copy machines.

SUMMARY OF THE INVENTION

In its basic aspect, the present invention provides a printing media pre-pick device for a pick mechanism adapted to engage a stack of media with a force sufficient to pick media from a stack of media. A mounting mechanism, connected to said pick mechanism, holds the pre-pick device in a predetermined relationship to said pick mechanism. The pre-pick device is biased against said stack of media. The biased pre-pick engages the first sheet of media prior to said pick mechanism with only enough frictional force to lift one sheet into a position where the pick mechanism can take over.

It is an advantage of the present invention that it provides a wider range of reliable operation for media stack, sheet pick mechanisms.

It is another advantage of the present invention that it provides a simple mechanism which can be retrofit to existing pick mechanisms.

It is yet another advantage of the present invention that it reduces the number of unwanted multi-sheet failures in sheet feeder devices, Other objects, features and advantages of the present invention will become apparent upon consideration of the following detailed description and the accompanying drawings, in which like reference designations represent like features throughout the FIGURES.

The drawings referred to in this description should be understood as not being drawn to scale except if specifically noted.

DETAILED DESCRIPTION OF THE INVENTION

Reference is made now in detail to a specific embodiment of the present invention, which illustrates the best mode presently contemplated by the inventor(s) for practicing the invention. Alternative embodiments are also briefly described as applicable. Paper loaded in an exchangeable cartridge will be used as an exemplary type of sheet feeder medium throughout this disclosure. However, it will be recognized by a person skilled in the art that the operation is substantially identical for any type of print medium in a stacker device and, therefore, no limitation is intended by the exemplary embodiments disclosed.

Figure 1:
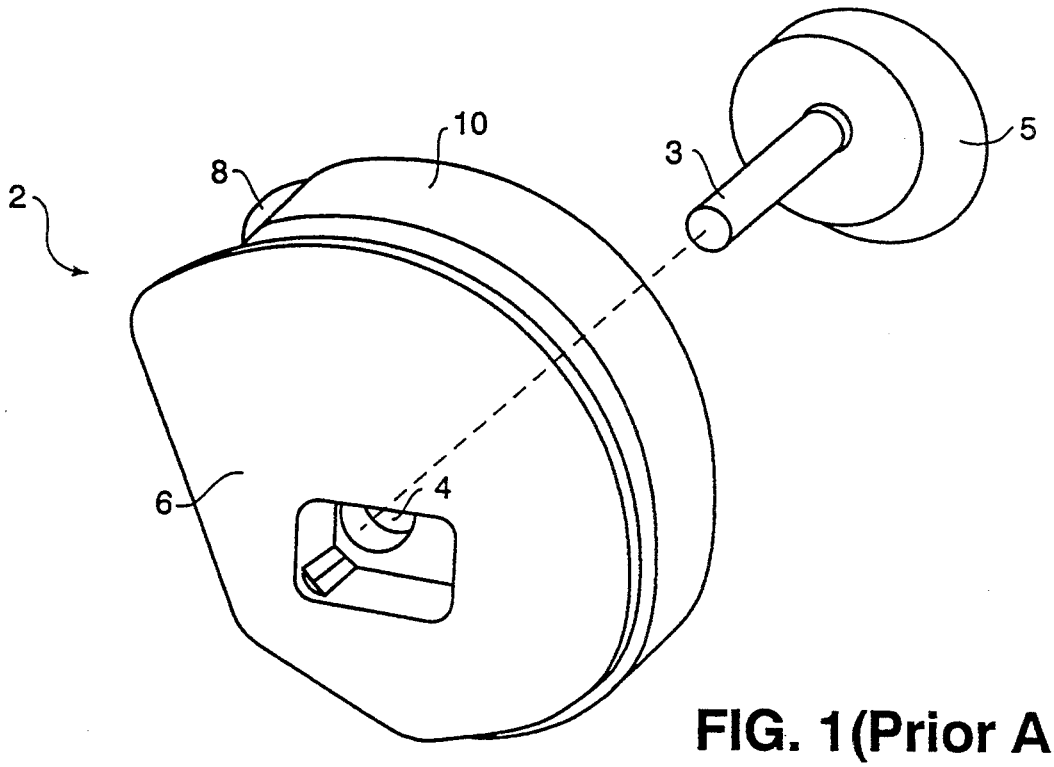
FIG. 1(Prior Art)
FIG. 1 (PRIOR ART) is a perspective view of a D-shaped, sheet feeder pick roller.
Figure 2:
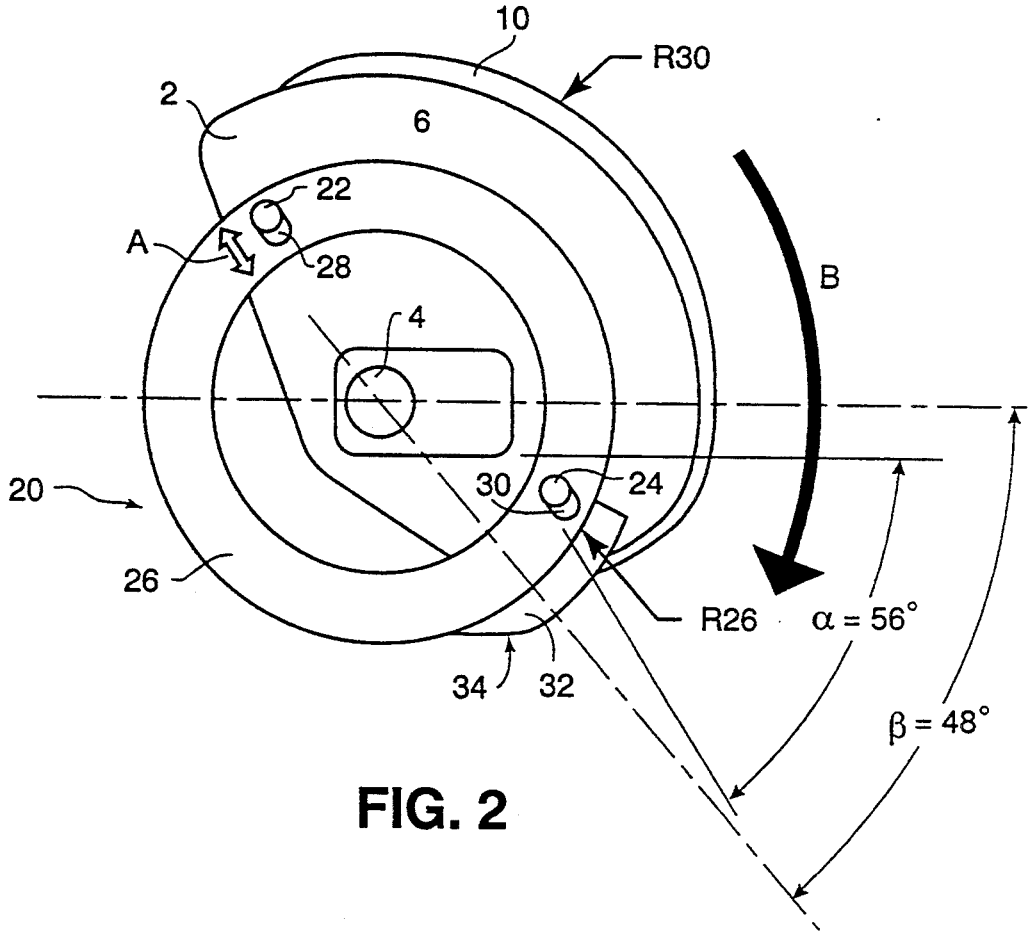
FIG. 2 is a plan view (side) of the print media picking device of the present invention.
Figure 3:
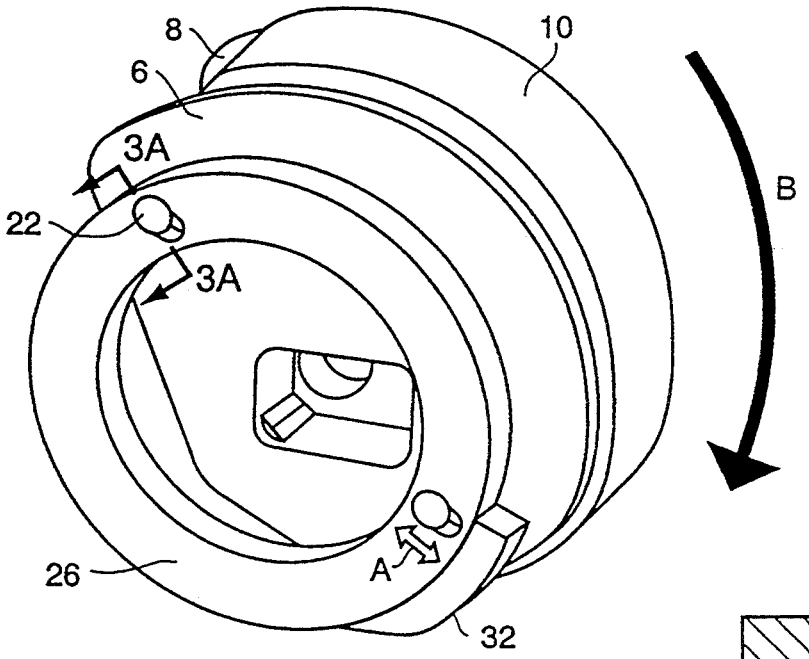
FIG. 3 is a perspective view of the present invention as shown in FIG. 2.
Figure 3A:
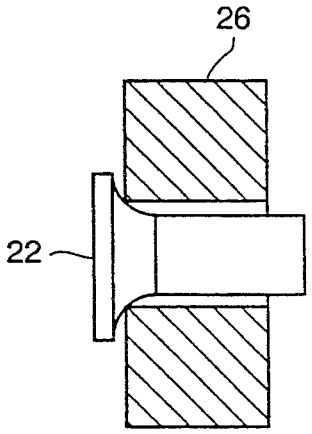
FIG. 3A is a sectional view taken in plane 3A—3A as shown in FIG. 3.

As shown in FIGS. 2 and 3, a pre-pick device 20 is designed to attach to a D-shaped pick roller 2 (such as shown in FIG. 1). The pick roller 2 is generally connected to a drive motor 5 via a rotating drive shaft 3. The motor is connected to an electronic controller (not shown) issuing FEED commands when a sheet of paper is to be loaded into the hard copy machine.

Two mounting pins 22, 24 are located on one or the other side plate 6, 8 at opposing regions. (While two pre-pick devices 20 could be mounted, one on each side plate 6, 8 of the pick roller 2, it has been found that in most applications only one pre-pick device 20 is required.) The mounting pins 22, 24 are designed to capture a weight ring 26 in a loose, sliding engagement manner via slots 28, 30 provided in the weight ring 26. Alternatively, capture screws designed to mate with complementary tapped bore holes in the pick roller side plate or flared-tip pins on the side plates 6, 8 that allow a snap-fit of the weight ring 26 may be employed. Note also that the design shape of the sliding weight may be changed from a ring to any shape appropriate to a specific adaptation. The important aspect is that the weight ring 26 be free to slide back and forth, or "float," on the pins as indicated by arrow "A" in FIGS. 2 and 3. In other words, the force that will be exerted on a top sheet of a stack of paper will be determined by the predetermined mass of the weight 26 as the pre-pick device 20 is rotated in the direction of arrow "B" toward engagement with the paper stack.

Another friction member 32 is provided, mounted on the periphery of the weight ring 26 of the pre-pick device 20, adjacent to the pin 24 that generally constitutes the leading edge of the rotating pick roller friction member 10 as the pick roller 2 rotates about its shaft. The second friction member 32 can be a rubber "tire" or other such member similar to that of the pick roller friction member 10. When the pre-pick device 20 has slid on the mounting pins 22, 24 into the stack engagement position, the second friction member 32 is essentially concentric to the first friction member 10. The pre-pick friction member 32 on its outer peripheral lead-in region 34 extends radially approximately the same radial distance from the center of rotation as the first friction member 10.

In the exemplary embodiment of FIG. 2, the pick roller friction member 10 has a radius of thirty millimeters about shaft hole 4 and a circumferential length spanning nearly the entire radial curvature of the D-roller side plates 6, 8. The friction member 32 of the pre-pick device 20 is of a shorter circumferential length than said friction member 10 of the pick roller 2 and has a radius of twenty-six millimeters, with a increasing radius lead-in region 34 and a thickness "n." The pre-pick device 20 has a slightly smaller radius because it does not need to depress the stack of paper against the stack bias as does the pick roller 2.

As mentioned above the friction member 32 of the pre-pick device 20 is mounted on the weight ring 26 to float on the mounting pins 22, 24 as the pick roller 2 rotates about the drive shaft 3. Exemplary mounting relationship angles alpha and beta are shown in FIG. 2. By such mounting where the pre-pick friction member 32 leads the pick roller friction member 10 during rotation "B," the leading edge, circumferential region 34 of the pre-pick device friction member 32 (namely in the area of the increasing radius depicted) contacts the top sheet of the paper first. Since the pre-pick device 20 floats relative to the pick roller 2, the only downward force from the pre-pick device 20 is the weight of the device itself as it contact with the top of the stack of paper. Therefore, the shape and weight of the pre-pick device 20 is designed to provide a relatively light downward force that is enough to allow the pre-pick device friction member 32 to push only the top sheet of the stack forward without transmitting any substantial force to the sheets of paper below the top sheet. By allowing the pre-pick device 20 to float in this manner, a consistent light pick force is relatively ensured regardless of variations in location of the top sheet of the stack or the force of the upward bias on the stack.

In other words, as the pick roller 2 operationally rotates in direction "B," the weight ring 26 will slip towards the top of the stack of paper. The pre-pick device friction member region 34 will contact the top sheet of the stack first. As the rotation continues, friction from the increasing contact with pre-pick device friction member 32 will cause only the top sheet to begin moving in the intended direction as the opposing bias force on the stack also floats the weight ring 26 upward along the mounting slots 28, 30 as depicted by arrow "A." Before contact is lost or slips appreciably between the pre-pick device friction member 32 and the top sheet, the sheet comes into contact with the pick roller friction member 10. As rotation in direction "B continues, friction between the pre-picked single sheet and the pick roller friction member 2 proceeds as described above to move the sheet into the machine media transport mechanism.

As rotation continues, the pre-pick device 20 is freed to float back downward toward the stack accordingly in order to pre-pick the next top sheet from the stack.

Figure 4:
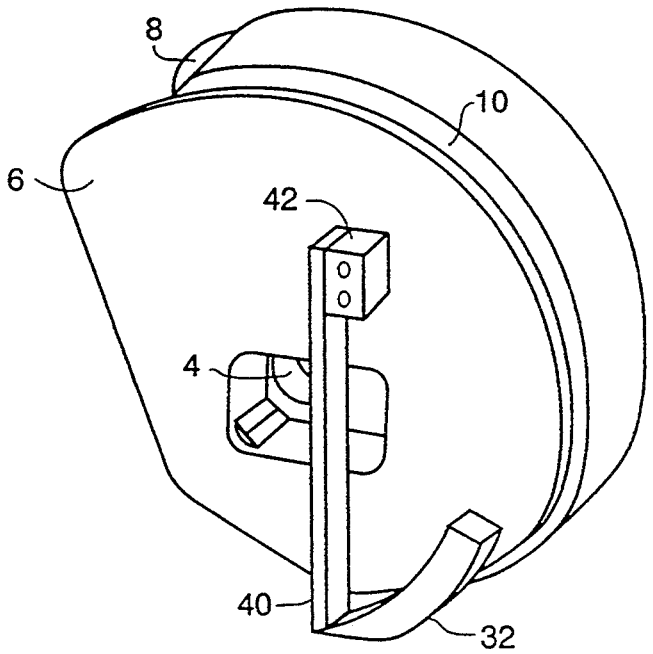
FIG. 4 is a perspective view of an alternative embodiment of the present invention.

The size, shape, and dimensions of the pre-pick device 20 can be varied in accordance with the design requirements of the particular hard copy machine design criteria. Referring now to FIG. 4, an alternative embodiment of the present invention is depicted.

The weight ring of the previous embodiment has been replaced with a spring 40 adapted to mount the pre-pick device friction member 32 in appropriate relationship to the pick roller friction member 10 as previously disclosed. Such an alternative pre-pick device can be simply mounted to a side plate of a pick roller 2 by any fixedly mounting device 42, such as a screw, or an adhesive. This simplified mounting technique facilitates retrofit to installed base hard copy machines in which multiple sheet picks is problematical. Operation is virtually identical with the force provided by the weight ring mass being replaced by the predetermined spring constant design.

The foregoing description of the preferred embodiment of the present invention has been presented for purposes of illustration and description. It is not intended to be exhaustive or to limit the invention to the precise form disclosed. Obviously, many modifications and variations will be apparent to practitioners skilled in this art. The embodiment was chosen and described in order to best explain the principles of the invention and its best mode practical application to thereby enable others skilled in the art to understand the invention for various embodiments and with various modifications as are suited to the particular use contemplated. It is intended that the scope of the invention be defined by the claims appended hereto and their equivalents.

What is claimed is:

1. A print media picking device for a hard copy apparatus, having a stack of cut-sheet printing media adapted for single sheet feed to a sheet transport mechanism of said hard copy apparatus, comprising:

driving means for selectively actuating said media picking device, a mounting shaft coupled to said driving means, having a longitudinal axis defining an axis of rotation, a pick roller, having a D-shape with a D-rim mounted first friction member, mounted on said shaft for concentric rotation about said shaft at a first radial distance about the longitudinal axis of rotation of said shaft, such that said D-rim mounted first friction member has a first fixed radius of radial rotation about said axis of rotation and engages a top sheet of said stack of cut-sheet printing media with a first predetermined frictional force, and a second friction member mounted on said pick roller, having a surface region defining a variable radius of radial rotation such that said surface region of said second friction member pre-engages said top sheet of cut-sheet printing media of said stack with a second predetermined force that is less than said first predetermined force prior to said first friction member engaging said top sheet.

2. The device as set forth in claim 1, wherein said second friction means further comprises:

a weight-mounted friction pad mounted in order to change position thereon and having a predetermined mass such that said force that said top sheet is engaged with is a function of said mass.

3. The device as set forth in claim 1, wherein said second friction means further comprises:

a friction pad mounted on a spring having a predetermined spring constant such that said force that said top sheet is engaged with is a function of said spring constant.

4. A hard copy media pick mechanism for picking a top sheet from a stack of cut-sheet print media, comprising:

a motor having a shaft selectively rotated on its axis thereby;

a pick roller fixedly mounted on said shaft for rotation therewith, having a body and an arcuate face on a portion of said body, said arcuate face having a first frictional surface with a radius defining a first arcuate path concentric to said axis greater than an arcuate path defined by said pick roller body;

a pre-pick member, having a weight ring slidably mounted on said pick roller adjacently said arcuate face portion and further having a second friction surface adapted to engage said top sheet before said first frictional surface of said pick roller with a frictional force less than that to be exerted on said top sheet by said first frictional surface such that said top sheet starts moving in a predetermined direction prior to said first frictional surface engaging said top sheet.

5. The mechanism as set forth in claim 4, wherein said second frictional force is a function of mass of said weight ring.

* * * * *